US008402598B2

(12) United States Patent
Cho

(10) Patent No.: US 8,402,598 B2
(45) Date of Patent: Mar. 26, 2013

(54) UPRIGHT-TYPE VACUUM CLEANER

(75) Inventor: Jeong-Hee Cho, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 295 days.

(21) Appl. No.: 12/784,185

(22) Filed: May 20, 2010

(65) Prior Publication Data

US 2010/0313378 A1 Dec. 16, 2010

Related U.S. Application Data

(60) Provisional application No. 61/186,071, filed on Jun. 11, 2009.

(30) Foreign Application Priority Data

Aug. 27, 2009 (KR) ..... 10-2009-0079535

(51) Int. Cl.
*A47L 9/26* (2006.01)
*A47L 9/22* (2006.01)

(52) U.S. Cl. ..... 15/351; 15/323; 15/DIG. 10

(58) Field of Classification Search ..... 15/323, 15/351, DIG. 10
See application file for complete search history.

(56) References Cited

U.S. PATENT DOCUMENTS 4,693,734 A * 9/1987 Erickson, Jr. ..... 96/333
4,701,974 A * 10/1987 Konig et al. ..... 15/323
4,924,039 A * 5/1990 McAllise et al. ..... 191/12.2 R
5,535,500 A * 7/1996 Stephens et al. ..... 29/453
6,052,862 A * 4/2000 Lowery ..... 15/323
7,475,449 B2 * 1/2009 Lee ..... 15/326
8,141,202 B2 * 3/2012 Hawkins et al. ..... 15/352
2008/0127450 A1 * 6/2008 Hawkins et al. ..... 15/389

FOREIGN PATENT DOCUMENTS

JP 49-134955 11/1974
JP 07-124082 5/1995
JP 2001-029276 2/2001

OTHER PUBLICATIONS

United Kingdom Office Action issued on Sep. 29, 2010, in corresponding United Kingdom Patent Application No. GB1009048.8 (3 pages).

* cited by examiner

*Primary Examiner* — William Gilbert
*Assistant Examiner* — Alp Akbasli
(74) *Attorney, Agent, or Firm* — NSIP Law

(57) ABSTRACT

An upright-type vacuum cleaner is provided. The upright-type vacuum cleaner includes a cleaner body comprising a motor chamber in which a suction motor is mounted, a brush assembly connected to the cleaner body, a discharge filter unit mounted on a first surface of the cleaner body, to filter out impurities from an air stream discharged from the suction motor, and a cord reel assembly mounted on a second surface of the cleaner body and having a power cord. The discharge filter unit includes a filter member mountable and demountable to and from the cleaner body by a user outside the vacuum cleaner, and at least a part of an air stream filtered by the filter member shifts a direction to pass through the cord reel assembly.

11 Claims, 13 Drawing Sheets

UPRIGHT-TYPE VACUUM CLEANER

CROSS-REFERENCE TO RELATED APPLICATIONS

This application claims the benefit under 35 U.S.C. §119 (e)(1) of U.S. Provisional Application No. 61/186,071, filed on Jun. 11, 2009, in the United States Patent and Trademark Office, and the benefit under 35 U.S.C. §119(a) of Korean Patent Application No. 10-2009-0079535, filed on Aug. 27, 2009, in the Korean Intellectual Property Office, the entire disclosure of each of which is incorporated herein by reference for all purposes.

BACKGROUND

1. Field

The following description relates to an upright-type vacuum cleaner, and more particularly, to an upright-type vacuum cleaner which may cool a power cord.

2. Description of the Related Art

A vacuum cleaner may generally operate to draw in an external air stream containing dust from a surface being cleaned, separate dust at a dust separating and collecting unit, and discharge out a clean air stream. Such vacuum cleaners may employ a cord reel assembly having therein a reel of power cord to supply power to the vacuum cleaner. Considering that the power cord may generate heat as the vacuum cleaner is operated, the vacuum cleaner may employ a structure in which an air stream discharged from a suction motor is passed through the cord reel assembly to thereby cool the heat from the power cord before the air stream is discharged out via a discharge filter.

However, the above-explained vacuum cleaner may have drawbacks. In particular, because the air stream from a carbon brush of the suction motor may be passed through the cord reel assembly before the discharge filter, a carbon powder, which may be contained in the air stream, may contaminate the power cord.

Japan Patent Publication No. 07-124082 ("JP '082") and U.S. Pat. No. 6,052,862 ("US '862) recognize the abovementioned problem, and suggest a structure in which an air stream from the suction motor is secondly purified through a discharge filter, and then moved to a cord reel assembly to cool a power cord housed therein and discharged out of the vacuum cleaner.

However, according to JP '082, the discharge filter is housed within a vacuum cleaner body, and not removable from the vacuum cleaner body and thus cannot be cleaned. According to US '862, the cord reel assembly covers the discharge filter. Therefore, in order to remove the discharge filter from the vacuum cleaner body, a user has to separate the cord reel assembly from the vacuum cleaner body first. Accordingly, the discharge filter of US '862 may be difficult to clean.

SUMMARY

In one general aspect, there is provided an upright-type vacuum cleaner, the vacuum cleaner including a cleaner body including a motor chamber in which a suction motor is mounted, a brush assembly connected to the cleaner body, a discharge filter unit mounted on a first surface of the cleaner body, to filter out impurities from an air stream discharged from the suction motor, and a cord reel assembly mounted on a second surface of the cleaner body and having a power cord. The discharge filter unit includes a filter member mountable and demountable to and from the cleaner body by a user outside the vacuum cleaner, and at least a part of an air stream filtered by the filter member shifts a direction to pass through the cord reel assembly.

The discharge filter unit may be mounted on a side surface of the cleaner body, and the cord reel assembly may be mounted on a rear surface of the cleaner body adjoined and fluidly connected to the discharge filter unit.

Alternatively, the discharge filter unit may be mounted on a rear surface of the cleaner body, and the cord reel assembly may be mounted on a side surface of the cleaner body adjoined and fluidly connected to the discharge filter unit.

The discharge filter unit may include a discharge filter body formed on the cleaner body, the discharge filter body to which the filter member may be removably mounted, and a discharge filter cover to selectively open the discharge filter body. The discharge filter cover may include a hinge portion formed on a first side to be pivotably connected to the discharge filter body, and a pair of locking portions formed on a second side at a predetermined distance from each other to be selectively locked with the discharge filter body.

The discharge filter cover may include an extended portion between the pair of locking portions, to form a duct passage through which, in a state that the discharge filter cover closes the discharge filter body, an air stream, from which impurities are filtered as the air stream is passed through the filter member, may change a flow direction perpendicularly to thus move into the cord reel assembly.

The discharge filter body may include a first communicating port formed on a lower portion and fluidly connected to the motor chamber, and a second communicating portion formed on a location of a side surface corresponding to the extended portion and fluidly connected to an interior of the cord reel assembly.

The discharge filter body may include a first communicating port formed on a lower portion and fluidly connected to the motor chamber, and the cord reel assembly includes a second communicating portion formed on a location of a rear surface corresponding to the extended portion and fluidly connected to an interior of the cord reel assembly.

The discharge filter unit shifts a flow of the filtered air stream.

The discharge filter unit and the cord reel assembly may be extended from the cleaner body.

In another aspect, there is provided a vacuum cleaner including a cleaner body, a brush portion, a suction motor, a cyclone unit, a pre-motor filter unit, a discharge filter mounted on the cleaner body, and a cord reel mounted on the cleaner body on a different plane than the discharge filter. An air stream is drawn into the cyclone unit where dust is separated from the air stream, the air stream is discharged to the pre-motor filter unit where residual dust is removed, the air stream flows through the suction motor to the discharge filter, and at the discharge filter a portion of the air stream is discharged through a discharging portion, and another portion of the air stream is shifted in direction by an extended portion to pass through the cord reel assembly.

Other features and aspects will be apparent from the following detailed description, the drawings and the claims.

Figure 1:
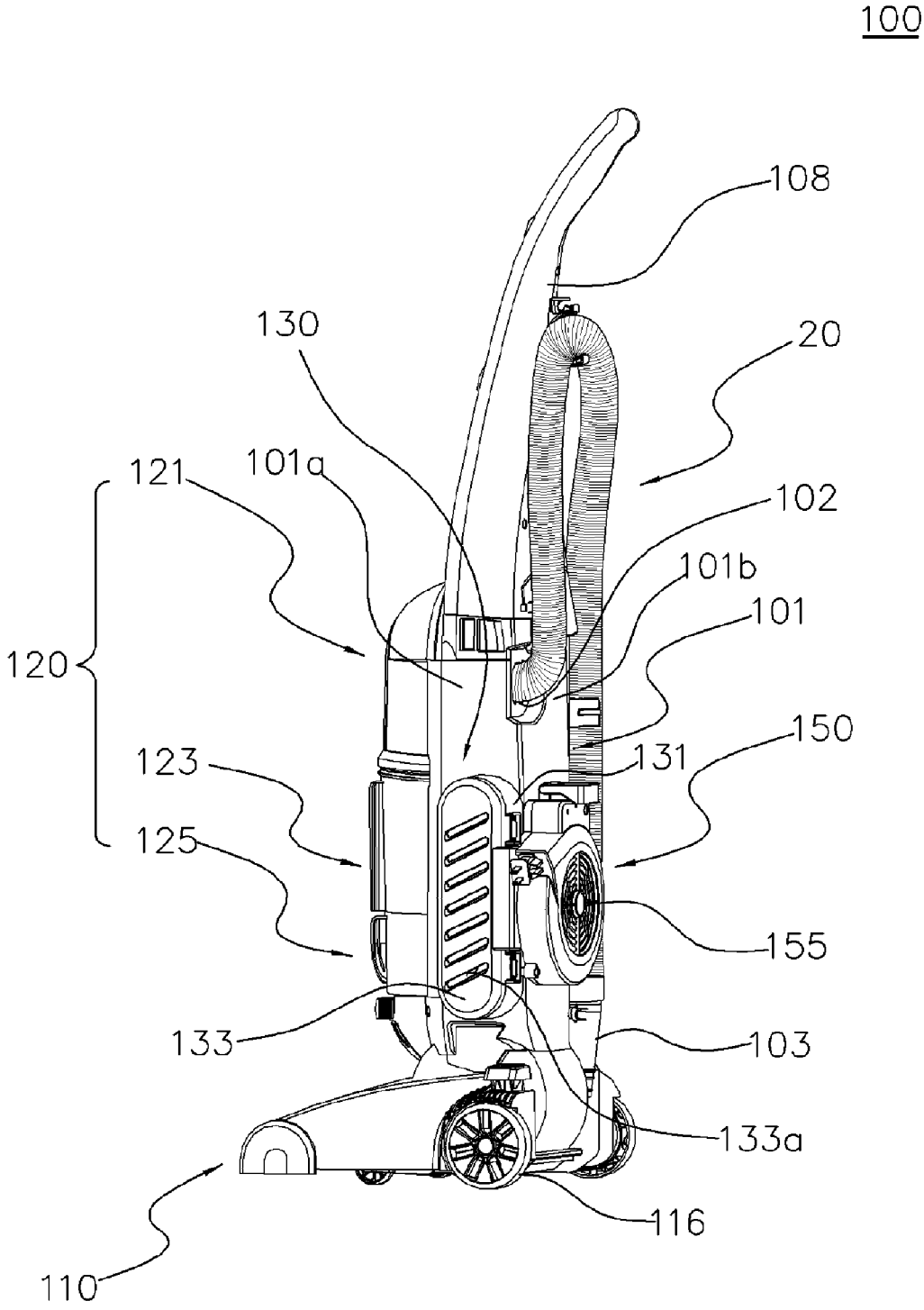
FIG. 1 is a perspective view of an example of a vacuum cleaner.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

An example of an upright-type vacuum cleaner 100 is explained below with reference to the accompanying drawings.

Figure 2:
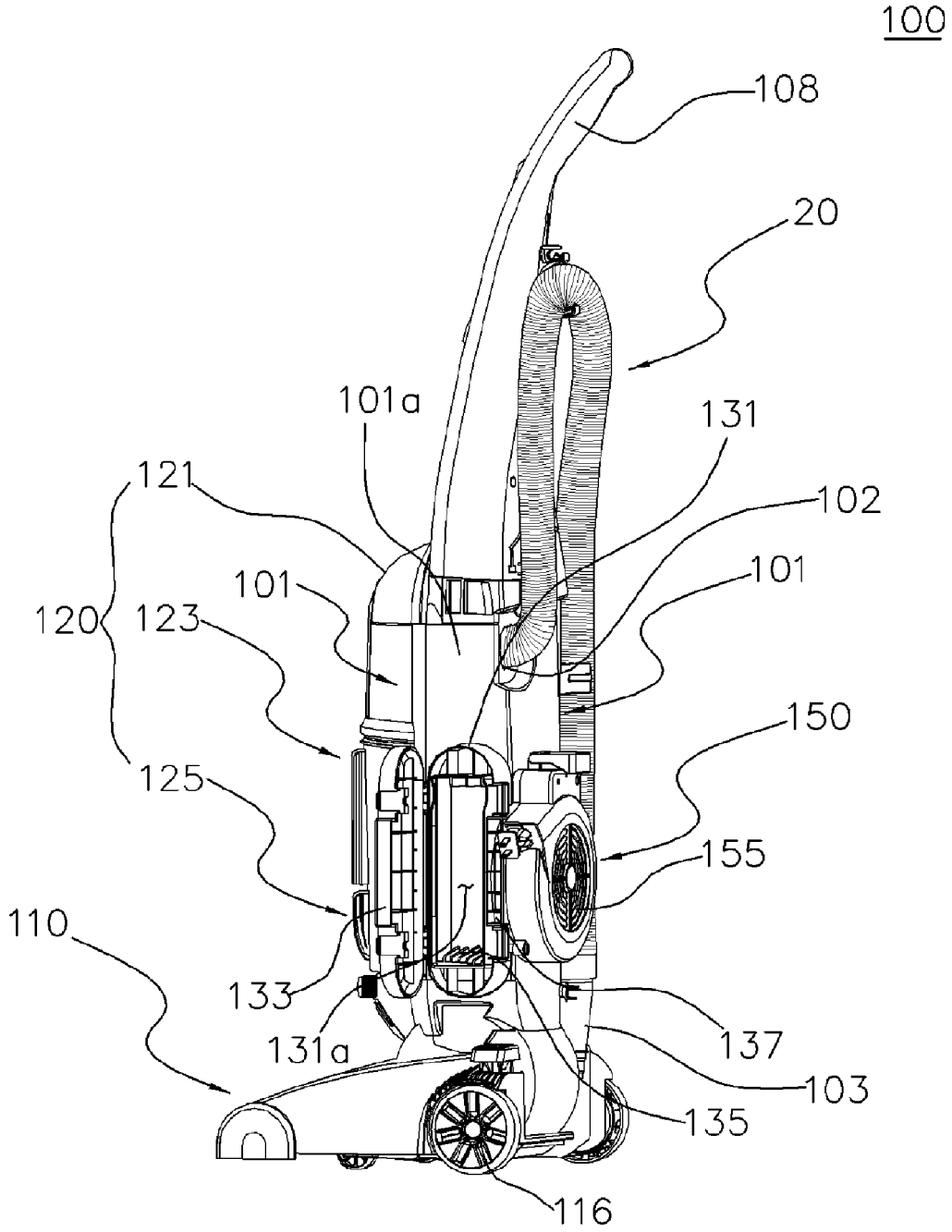
FIG. 2 is a perspective view illustrating an example of discharge filter cover in a pivoted position, and in which the filter member of FIG. 1 is omitted.

Referring to the examples shown in FIGS. 1 and 2, the upright-type vacuum cleaner 100 includes a cleaner body 101, a nozzle assembly 110, a dust separating and collecting unit 120, a discharge filter unit 130, and a cord reel assembly 150.

The cleaner body 101 includes a handle portion 108 formed on an upper portion, the dust separating and collecting unit 120 formed on a front side, and the nozzle assembly 110 pivotably formed on a lower portion. A hose coupling hole 102 may be formed on a rear upper portion of the cleaner body 110, and a hose coupling pipe 103 may be formed on a rear lower portion. The hose coupling hole 102 and the hose coupling pipe 103 may be fluidly connected to each other by a hose 20.

The discharge filter unit 130 may be protrudingly formed on a side 101*a* of the cleaner body 101, and the cord reel assembly 150 may be protrudingly formed on a rear side 101*b*. The discharge filter unit 130 and the cord reel assembly 150 may be adjoined with each other and are fluidly connected to each other. The discharge filter unit 130 and the cord reel assembly 150 may be arranged almost perpendicularly relative to each other.

Figure 3A:
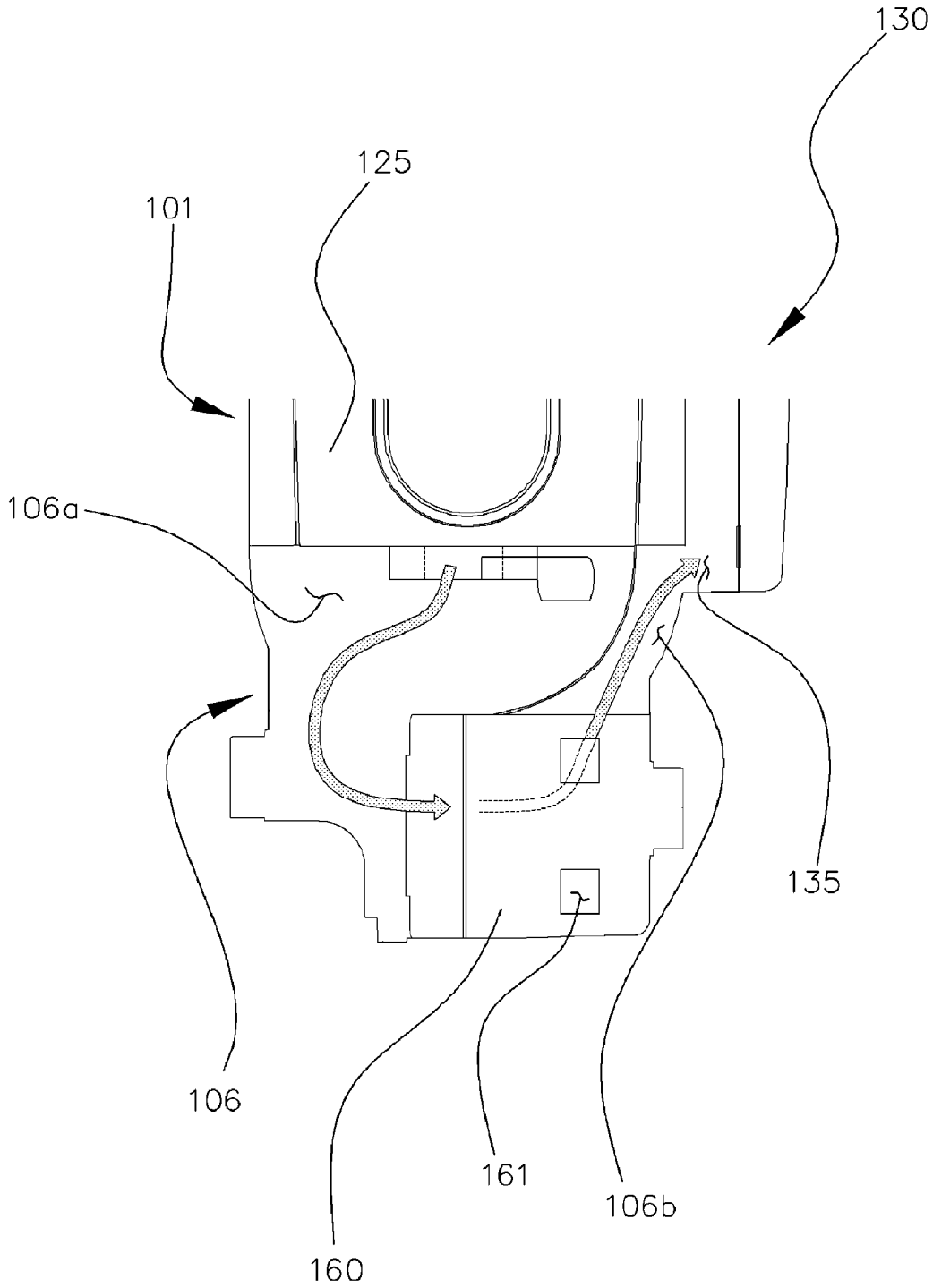
FIG. 3A is a view illustrating an example of a flow of air stream in a motor chamber in FIG. 1.

Referring to the example illustrated in FIG. 3A, the cleaner body 101 includes a motor chamber 106 in which a suction motor 160 may be mounted on an inner lower side. The motor chamber 106 includes a motor suction path 106*a* fluidly connected to a lower portion of the dust separating and collecting unit 120, and a motor discharge path 106*b* fluidly connected to the discharge filter unit 130.

The nozzle assembly 110 may be pivotably formed on a lower portion of the cleaner body 101, and a suction port (not illustrated), which may generally be formed on a bottom surface of the nozzle assembly 110, is fluidly connected to the hose coupling pipe 103. Accordingly, a drawn-in air stream and dust, introduced through the nozzle assembly 110, may be moved to the hose coupling pipe 103. Movable wheels 116 may be formed on both sides of the nozzle assembly 110 to allow the vacuum cleaner 110 to move along a surface.

The dust separating and collecting unit 120 includes a cyclone unit 121, a dust receptacle 123, and a pre-motor filter portion 125. The cyclone unit 121, the dust receptacle 123, and the pre-motor filter portion 125 may be arranged on a front surface of the cleaner body 101 in order from the upper to lower direction. The dust receptacle 123 and the pre-motor filter portion 125 may be removable from the cleaner body 101, while the cyclone unit 121 may be fixed to the cleaner body 101. If dust-containing air stream is introduced into the cyclone unit 121 through the hose coupling hole 102, dust may be separated from the air stream by centrifugal force and collected in the dust receptacle 123. The once-centrifuged air stream may be then moved to the pre-motor filter portion 125 to have a second filtering intended to remove minute dust from the air stream. The twice-filtered air stream, free or substantially free of dust, including minute dust, may be discharged to a lower portion of the pre-motor filter portion 125. The pre-motor filter portion 125 may be fluidly connected to a motor suction path 106*a* to allow a clean air stream to be discharged through a central lower portion (see FIG. 3A).

Figure 3B:
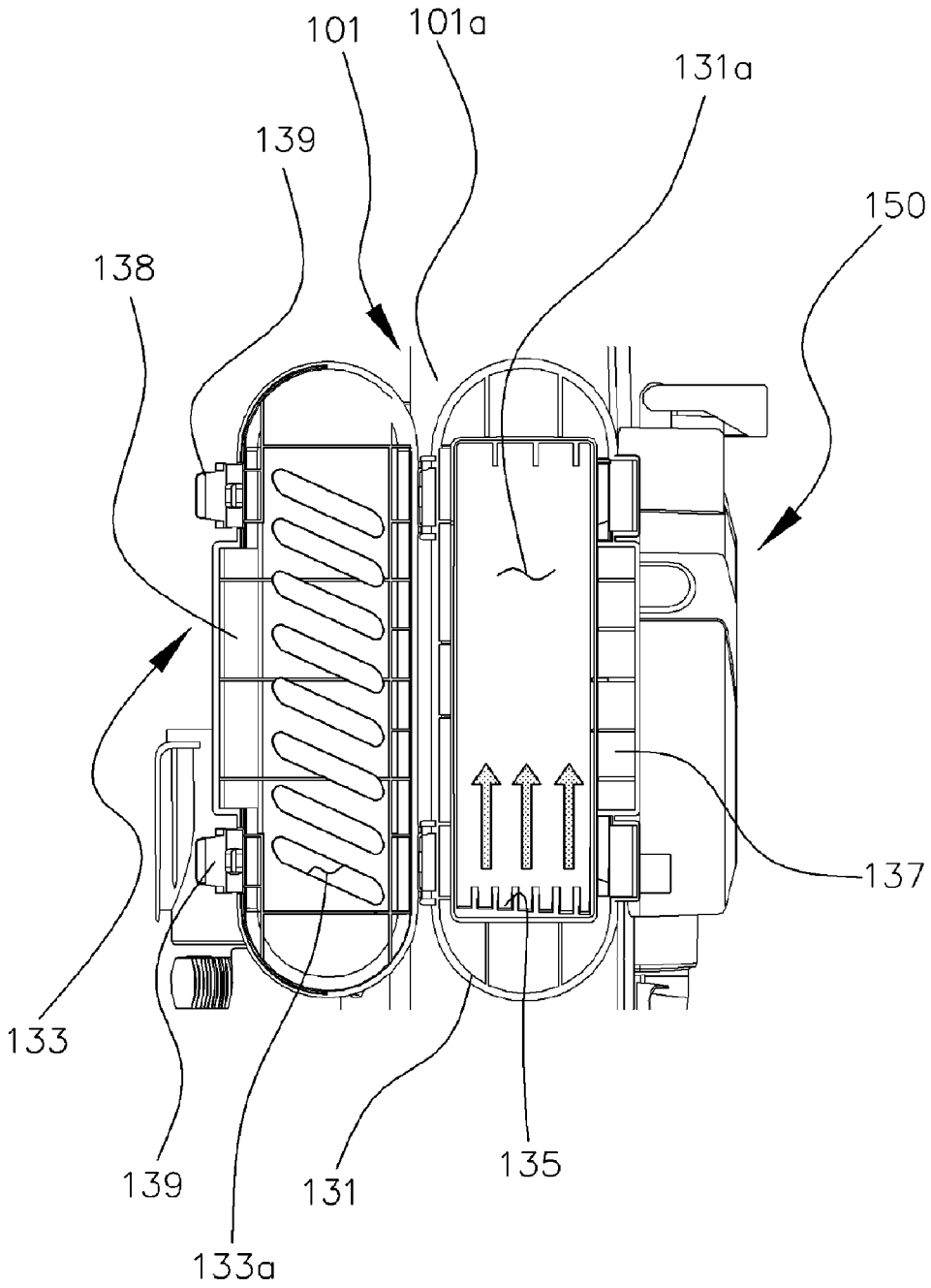
FIG. 3B is a view illustrating an example of an air stream from a motor chamber introduced into a discharge filter body in FIG. 1.

Referring to the example shown in FIG. 3B, the discharge filter unit 130 may be formed on the side 101*a* of the cleaner body 101, and include a discharge filter body 131, a filter member 134, and a discharge filter cover 133.

The discharge filter body 131 may be formed in an elliptical shape, and extended from the side 101*a* of the cleaner body 101. The discharge filter body 131 may have an open front portion, and be integrated with the cleaner body 101. A filter receiving opening 131*a* is formed in the discharge filter body 131 to receive the filter member 134 therein. The filter receiving opening 131*a* includes a first communicating port 135 on an inner lower surface to fluidly connect a motor discharge path 106*b* of the motor chamber 106 to the filter receiving opening 131*a*. The discharge filter body 131 includes a second communicating port 137 lengthwise formed on a side. The second communicating port 137 may be fluidly connected to an interior of the cord reel assembly 150 which is adjoined with the discharge filter unit 130 in a perpendicular relation.

The filter member 134 may be formed as a rectangular corrugated filter, and seated in the filter receiving opening of the discharge filter body 131. Although a corrugated filter is applied as an example of the filter member 134, other materials capable of filtering out impurities such as carbon powder from the air stream discharged through the motor discharge 106*b* may also be employed.

The discharge filter cover 133 may be formed with plural discharging ports 133*a*. The discharge filter cover 133 may be pivotably formed on the discharge filter body 131 to cover the filter member 134. One end of the discharge filter cover 133 may be pivotably connected to the discharge filter body 131 by a hinge 136, while a pair of locking members 139 at a predetermined distance from each other may be formed on the other end of the discharge filter cover 133 to selectively open the discharge filter body 131. The discharge filter body 131 may include a pair of locking holes 132 to be engaged with the locking members 139.

Meanwhile, the discharge filter cover 133 may include an extended portion 138 between the pair of locking members 139. If the discharge filter cover 133 is pivoted to close the discharge filter body 131 and thus cover the filter member 134, the locking members 139 are locked in the locking holes 132, and the extended portion 138 covers the second communicating port 137. Accordingly, the dust-free, or substantially dust-free, air stream, which is passed through the filter member 134, may change a direction to a perpendicular direction, and move into the cord reel assembly 150 through the second communicating port 137.

The cord reel assembly 150 may be arranged on the rear side 101*b* of the cleaner body 101 and in a perpendicular relation with respect to the discharge filter unit 130. A reel of power cord (not illustrated) may be housed in the cord reel assembly 150, and a discharge grill 155 may also be formed, having a cylindrical grill therein through which the dust-free air stream is discharged out. A cord reel assembly that is generally known 150 may be used, and therefore, further description of the cord reel assembly 150 is omitted.

An example of the flow of an air stream in the upright-type vacuum cleaner 100 is explained below with reference to FIGS. 3A to 3E.

Figure 3C:
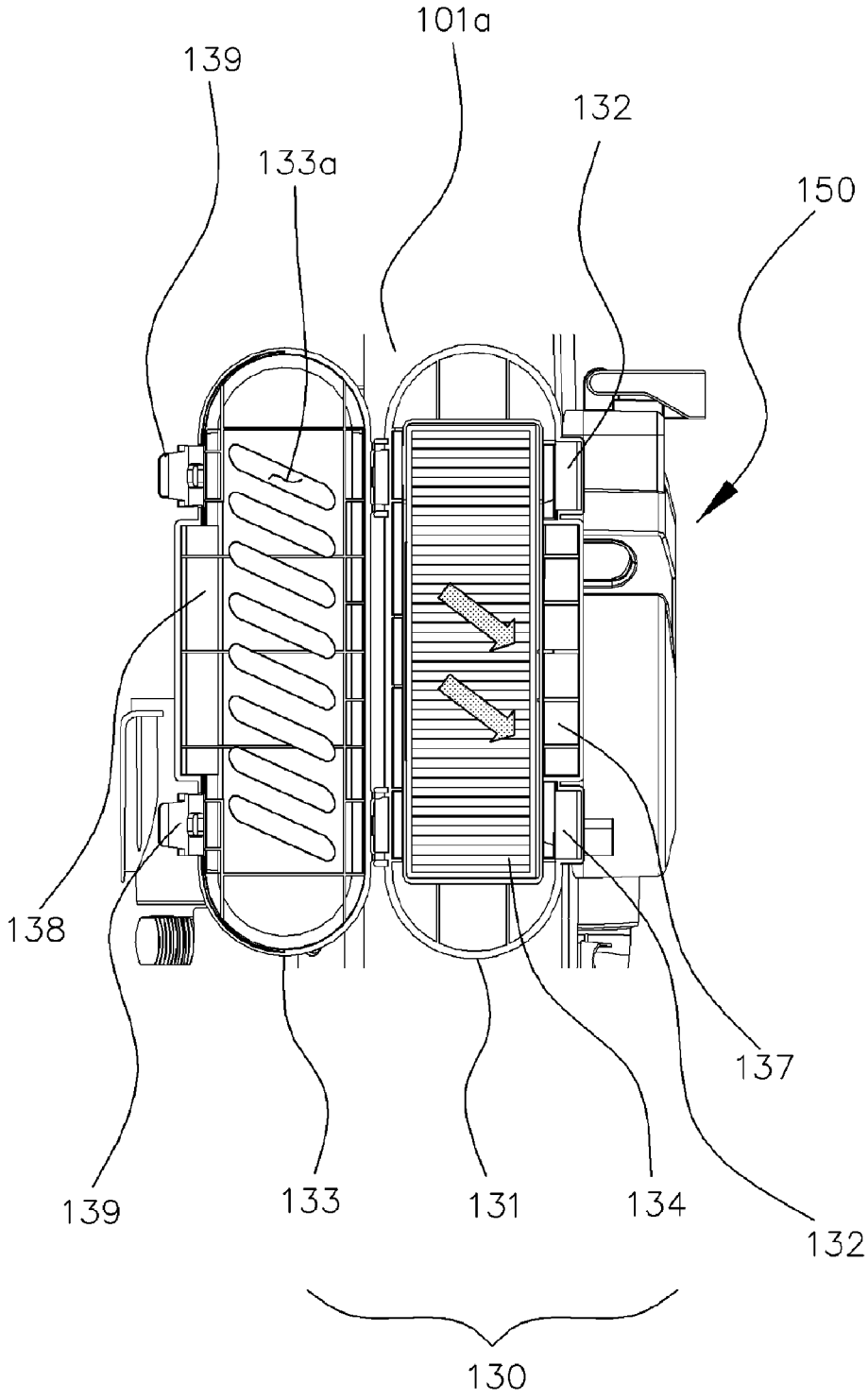
FIG. 3C is a view illustrating an example of an air stream passed through a filter member of a discharge filter body in FIG. 1.
Figure 3D:
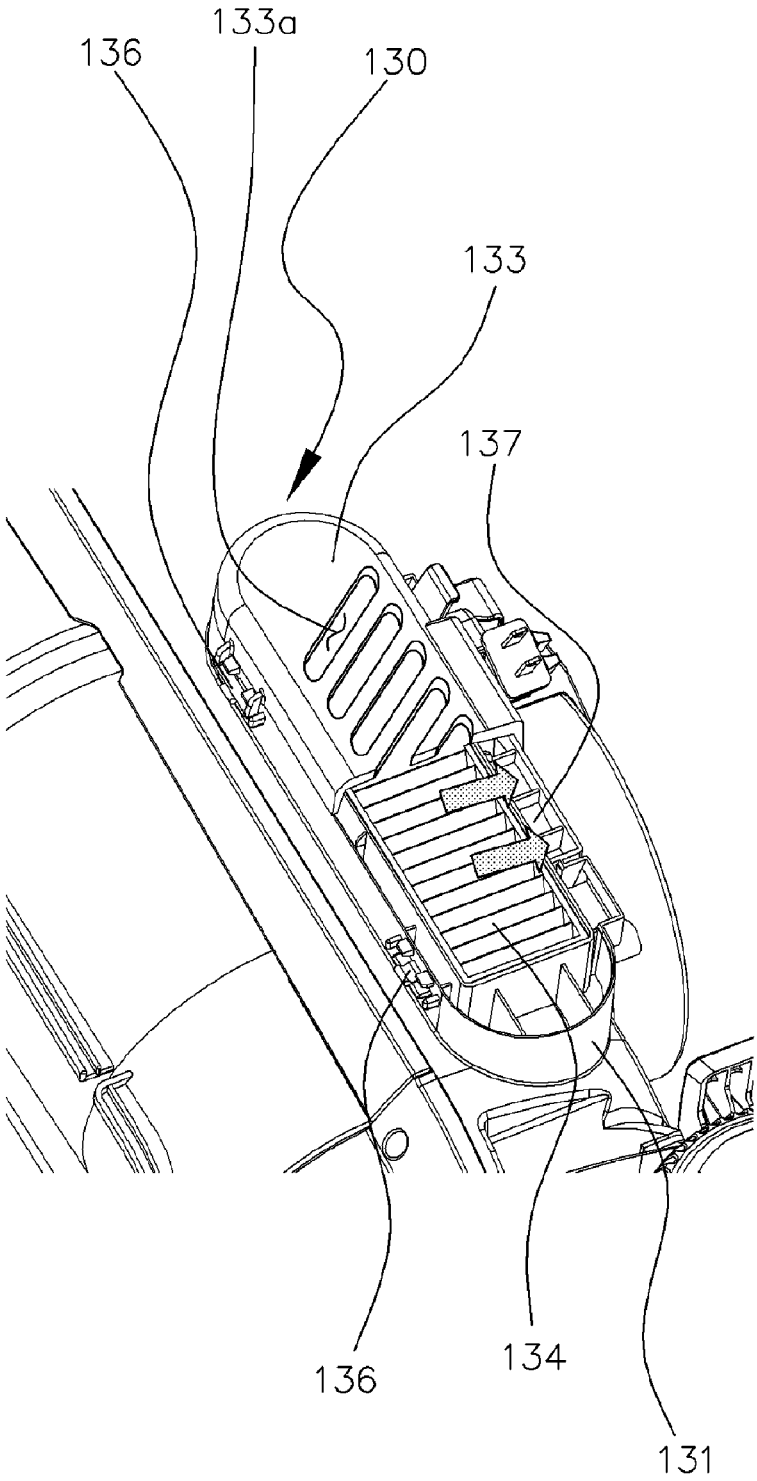
FIG. 3D is a view illustrating an example of an air stream moving from a discharge filter unit into a cord reel assembly in FIG. 1.
Figure 3E:
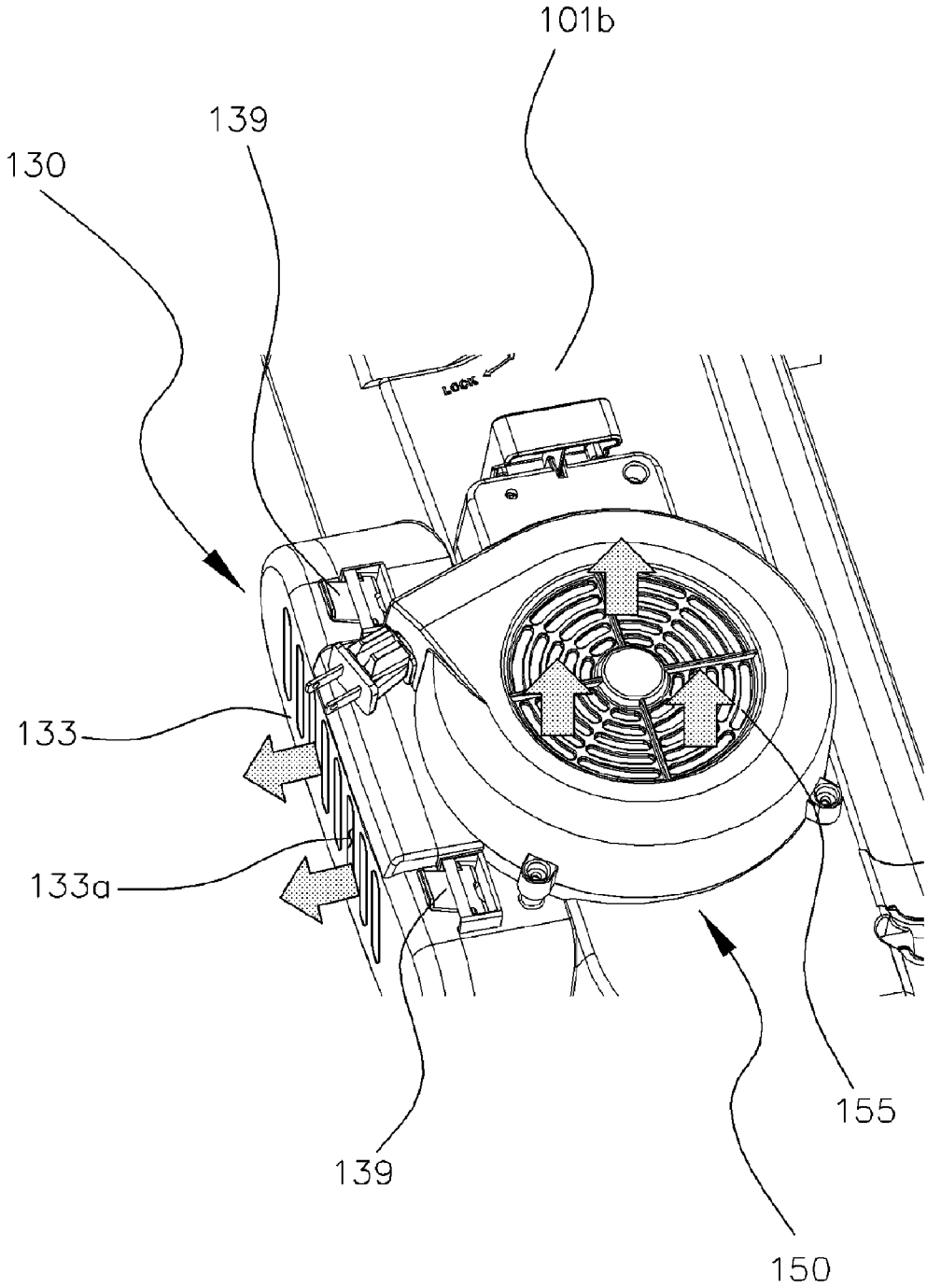
FIG. 3E is a view illustrating an example of an air stream discharged from a cord reel assembly in FIG. 1.
Figure 4:
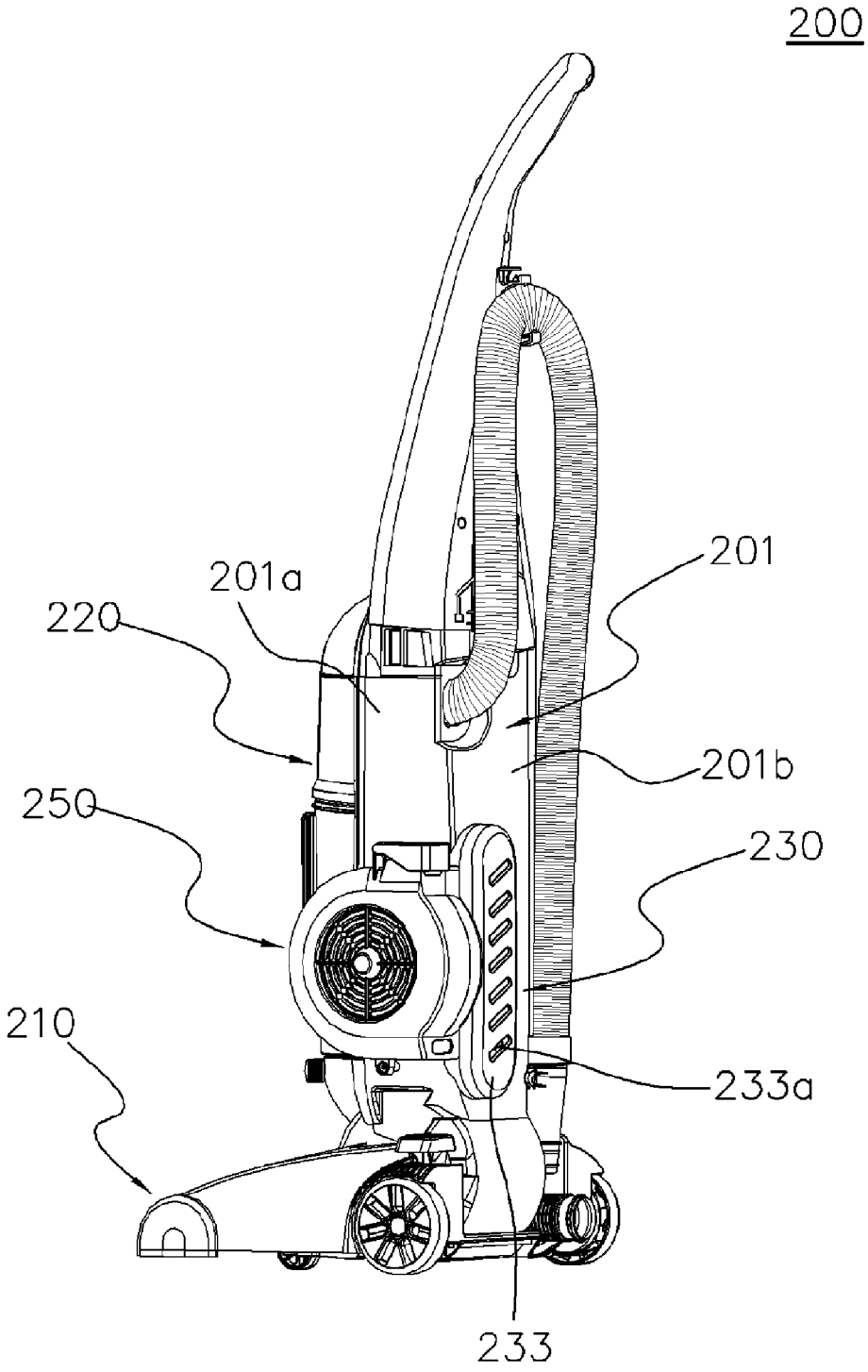
FIG. 4 is a perspective view of another example of a vacuum cleaner.
Figure 5:
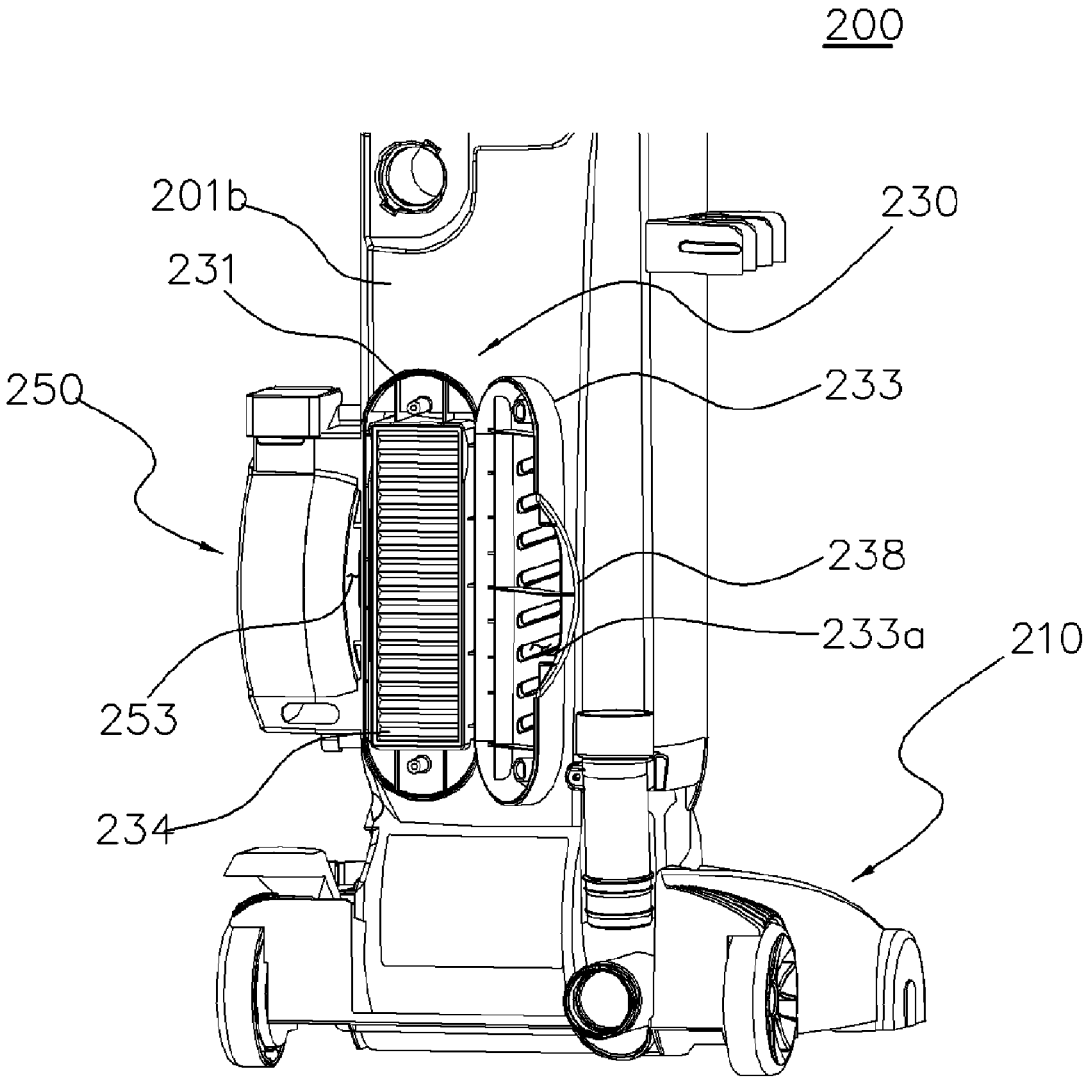
FIG. 5 is a perspective view illustrating an example of a discharge filter cover in an open state in FIG. 4.

FIG. 3A illustrates an example of a flow of an air stream in a motor chamber. FIG. 3B illustrates an example of the air stream from the motor chamber introduced into the discharge filter body. FIG. 3C illustrates an example of the air stream passed through the filter member of the discharge filter body. FIG. 3D illustrates an example of the air stream moved from the discharge filter unit into the cord reel assembly, and FIG. 3E illustrates an example of the air stream from the cord reel assembly discharged out.

With the supply of power to the suction motor 160, suction force is generated, and accordingly, an external air stream including dust from a surface being cleaned may be introduced into the dust separating and collecting unit 120 via the nozzle assembly 110 and the hose 20. The drawn-in air stream is centrifuged in the cyclone unit 121, so the dust separated from the drawn-in air stream is stored in the dust receptacle 123, while the centrifuged air stream is moved to the pre-motor filter portion 125 to have a second filtering intended to remove minute dusts (see FIG. 1).

Referring to the example in FIG. 3A, the filtered air stream is discharged to the lower portion of the pre-motor filter 125, moved into the motor suction path 106*a*, passed through the suction motor 160, and discharged through the motor discharge hole 161 and the motor discharge path 106*b*.

Referring to the example in FIG. 3B, the air stream from the motor discharge path 106*a* is introduced into the filter receiving opening 131*a* of the discharge filter body 131, and referring to FIG. 3C, moved toward the discharge filter cover 133 during which impurities such as carbon powder discharged from the suction motor 160, for example, are filtered by the filter member 134.

Referring to the example in FIG. 3D, a part of the filtered air stream filtered by the filter member 134, is discharged through the discharging port 133*a* of discharge filter cover 133, and the remaining air stream has a flow direction changed perpendicularly due to the extended portion 138 and thus is moved to the cord reel assembly 150 through the second communicating hole 137, and referring to FIG. 3E, cools the reel of power cord (not illustrated) housed in the cord reel assembly 150. The air stream is then discharged out through the discharge grill 155 formed on a rear portion of the cord reel assembly 150.

Meanwhile, to clean the discharge filter 134, the user may press the locking members 139 of the discharge filter cover 133 to release the locking members 139 from the locking holes 132, pivot the discharge filter cover 133 to open the discharge filter body 131, and take out the filter member 134 from the filter receiving opening 131*a* to clean impurities off the filter member 134, or replace the filter member 134 with a new one.

As explained above, in the upright-type vacuum cleaner 100, the discharge filter unit 130 may be formed on an outer surface of a side of the cleaner body 101, while the cord reel assembly 150 may be formed on an outer surface of a rear side of the cleaner body 101. Accordingly, a user may open the discharge filter cover 133 and take the filter member 134 out of the discharge filter body 131 to clean or replace the filter member 134 conveniently and easily. In other words, since the discharge filter unit 130 and the cord reel assembly 150 are formed on different planes from each other, and the user outside the cleaner body 101 can take out the filter member 134 by opening the discharge filter cover 133, the user inconvenience of having to remove the cord reel assembly 150 and then remove the discharge filter from the cleaner body 101 to clean or replace the filter member 134 may be resolved.

Additionally, the discharge filter unit 130 may not only remove impurities from an air stream from the suction motor 160, but also shift the flow of a apart of the impurity-cleaned air stream so that the air stream is moved to the cord reel assembly 150.

More specifically, since the discharge filter unit 130 and the cord reel assembly 150 may be adjoined with each other and arranged perpendicularly to each other in a fluidly connected manner, and the extended portion 138 is integrally formed on the discharge filter cover 133 of the discharge filter unit 130, a part of an air stream passed through the discharge filter 134 may be perpendicularly guided by the discharge filter cover 133 and the extended portion 138 to be passed through the interior of the cord reel assembly 150 and discharge out of the vacuum cleaner 100.

Another example of an upright-type vacuum cleaner 200 is explained below.

One difference of the vacuum cleaner 200 in this example from the vacuum cleaner 100 in the example above, is that a cord reel assembly 250 may be formed on a side surface 201*a* of the cleaner body 201, and a discharge filter unit 230 may be formed on a rear surface 201*b* of the cleaner body 201, as further explained below.

As explained above, the discharge filter unit 230 may be formed on the rear surface 201*b* of the cleaner body 201, and the cord reel assembly 250 may be formed on the side surface 201*a* of the cleaner body 201 in the exemplary vacuum cleaner 200. The discharge filter unit 230 and the cord reel assembly 250 may be partially adjoined with each other, and fluidly connected to each other. Accordingly, the discharge filter unit 230 and the cord reel assembly 250 may be almost perpendicularly arranged with respect to each other.

The discharge filter unit 230 includes a discharge filter body 231, a filter member 234, and a discharge filter cover 233.

Figure 6A:
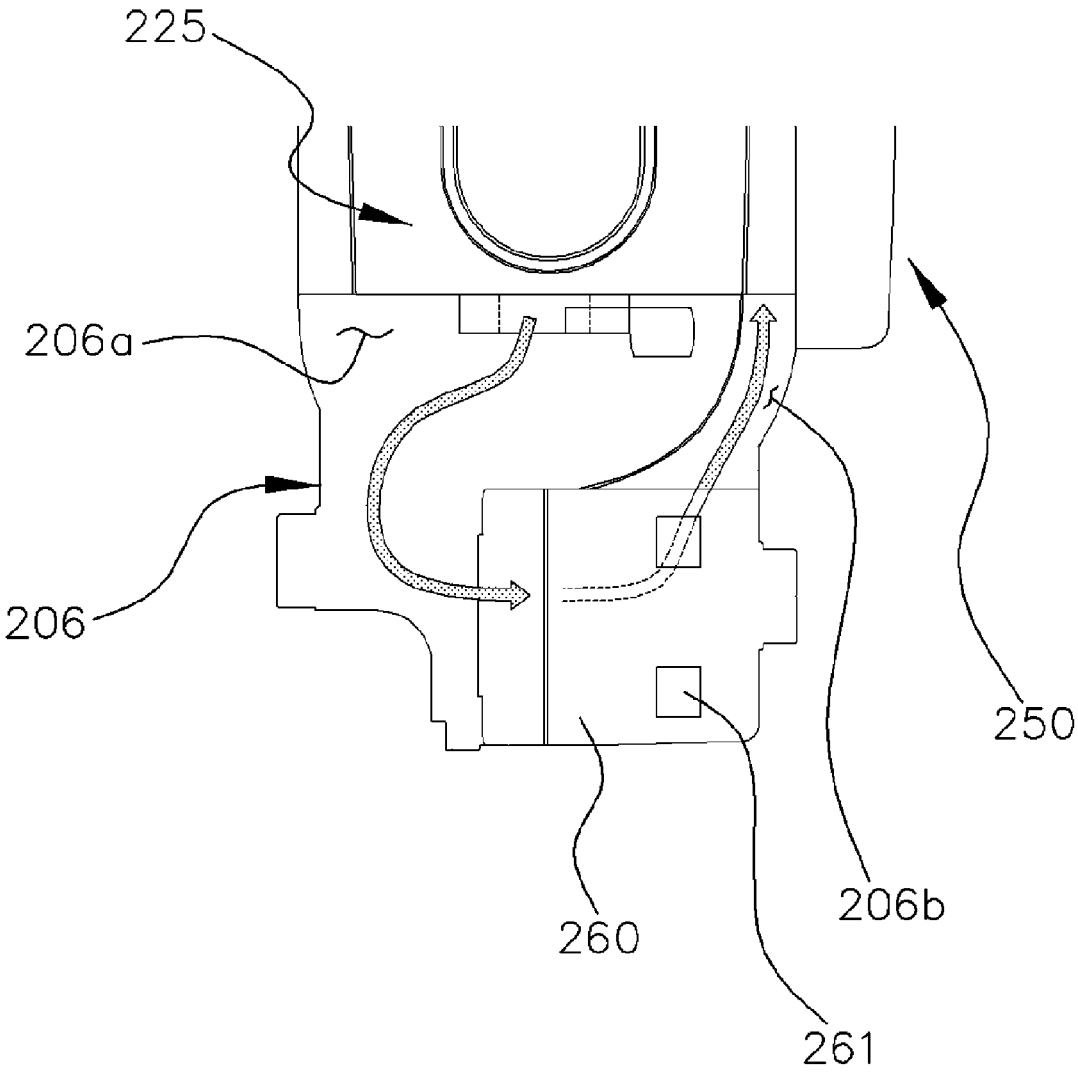
FIG. 6A is a view illustrating an example of an air stream in a motor chamber of FIG. 4.
Figure 6B:
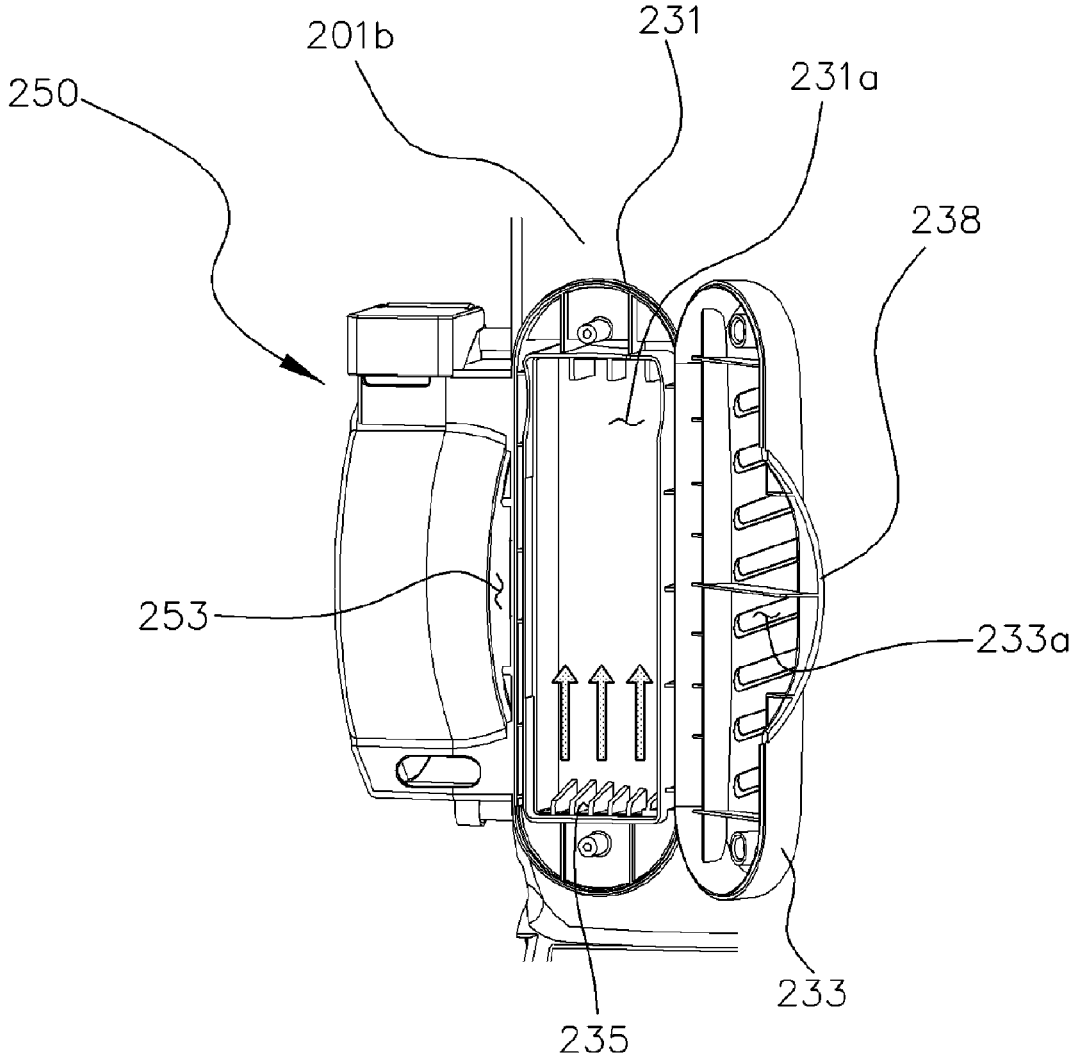
FIG. 6B is a view illustrating an example of an air stream from a motor chamber introduced into a discharge filter body in FIG. 4.

The discharge filter body 231 may be formed on the rear surface 201*b* of the cleaner body 230, and referring to FIG. 6B, include a filter receiving opening 231*a* formed in an inner central portion thereof. A first communicating port 235 may be formed on a lower side of the filter receiving opening 231*a*. The first communicating port 235 may be formed in a grill shape and fluidly connect a motor discharge path 206*b* to the filter receiving opening 231*a*.

Figure 6C:
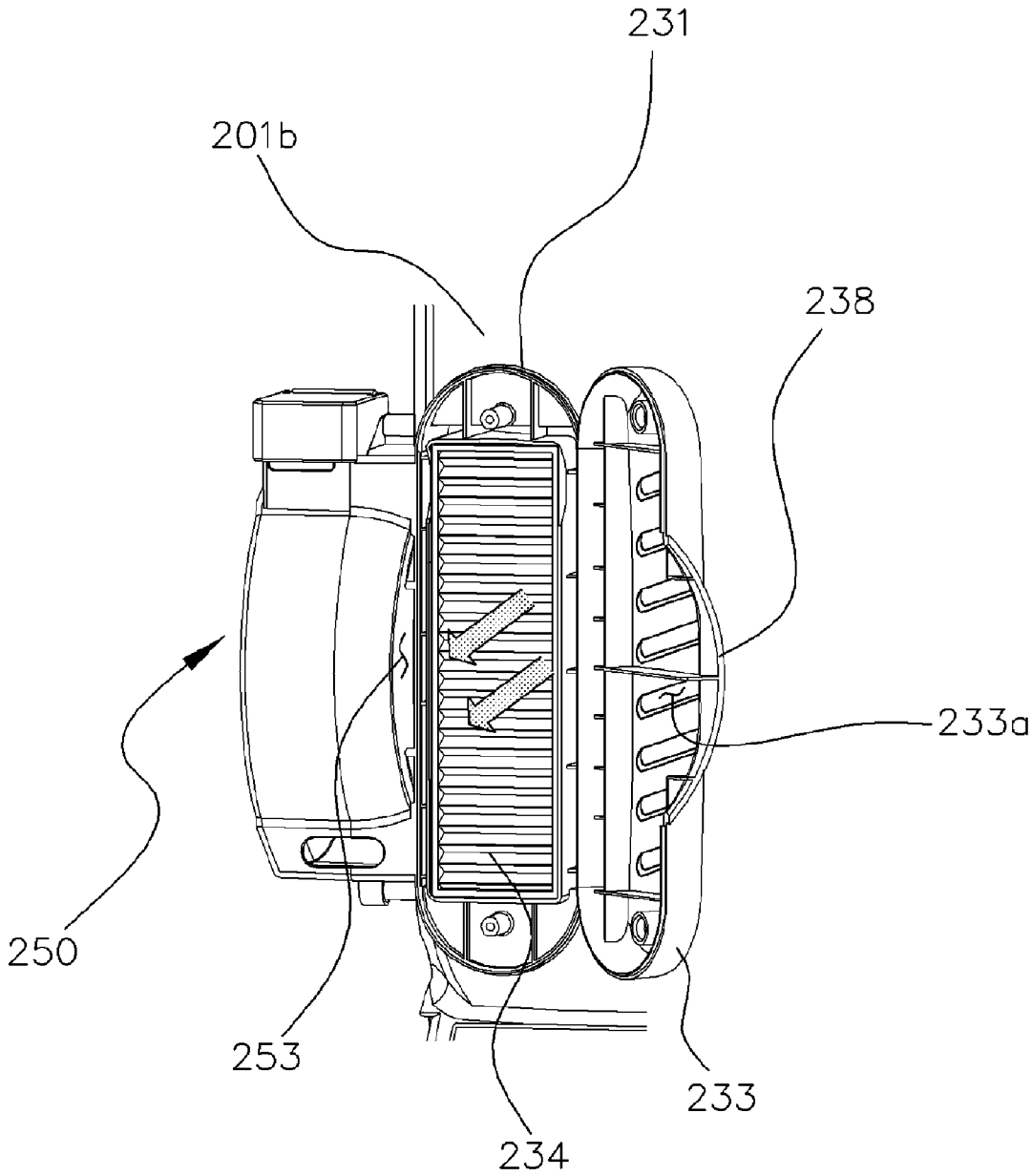
FIG. 6C is a view illustrating an example of an air stream passed through a filter member of a discharge filter body and moved to a cord reel assembly in FIG. 4.

Referring to the example in FIG. 6C, the filter member 234 may be formed as a rectangular corrugated filter, and seated in the filter receiving opening 231*a* formed in the discharge filter body 231. Although the filter member 234 is shown as a corrugated filter, other materials capable of filtering out impurities such as carbon powder from the discharged air stream may be used as well.

The discharge filter cover 233 may be formed with plural discharging ports 233*a*. The discharge filter cover 233 may be pivotably formed on the discharge filter body 231 to cover the filter member 234. The hinge portion and locking means similar to those employed in the example of the vacuum cleaner 100 described above may be employed in the example of the vacuum cleaner 200 described here, to selectively open the discharge filter cover 233 and the discharge filter body 231. An extended portion 238 may be formed on a side surface of the discharge filter cover 233.

The cord reel assembly 250 may be formed on the side surface 201*a* of the cleaner body 201, perpendicularly with respect to the discharge filter unit 230. A reel of power cord (not illustrated) may be housed in the cord reel assembly 250, and a discharge grill 155, having a cylindrical grill to allow the filtered air stream to be discharged outside, is formed on a front portion of the cord reel assembly 250. A second communicating port 253 is formed on a rear side surface of the cord reel assembly 250, in an adjoining manner relative to the discharge filter unit 230. Meanwhile, the extended portion 238 and the second communicating port 253 are formed in a corresponding shape so that, if the discharge filter cover 233 is pivoted to close the discharge filter body 231, covering the filter member 234, the second communicating port 253 of the cord reel assembly 250 is connected to the extended portion 238 of the discharge filter cover 233, forming a passage through which an air stream from the discharge filter unit 230 may be moved into the cord reel assembly 250.

An example of the air flow in the upright-type vacuum cleaner 200 is explained below with reference to FIGS. 6A to 6D, for the purposes of example.

Figure 6D:
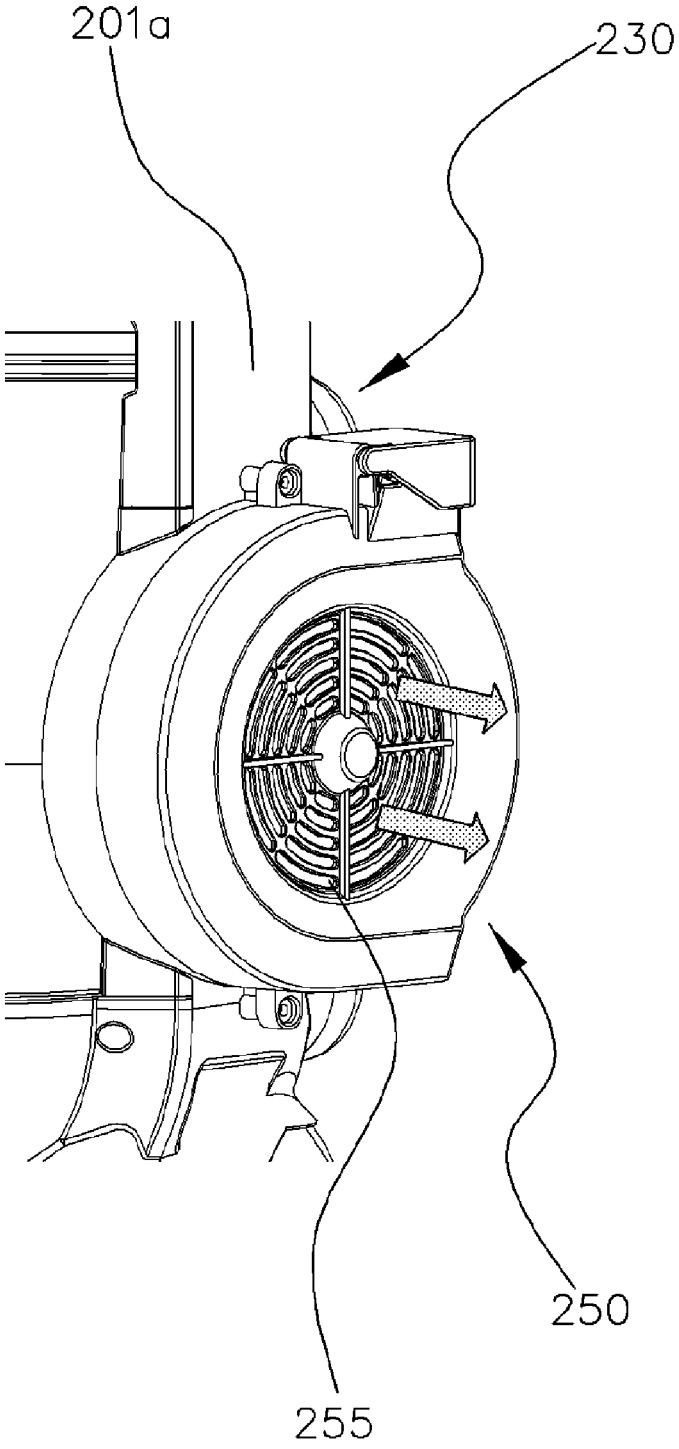
FIG. 6D is a view illustrating an example of an air stream discharged out of a cord reel assembly in FIG. 4.

FIG. 6A illustrates an example of an air flow in the motor chamber. FIG. 6B illustrates an example of an air stream from the motor chamber introduced into the discharge filter body. FIG. 6C illustrates an example of an air stream passed through the filter member of the discharge filter body and moved to the cord reel assembly, and FIG. 6D illustrates an example of an air stream discharged out of the cord reel assembly.

Since the process in which dust-containing air stream drawn in through the nozzle assembly 210 is centrifuged in the dust separating and collecting unit 220 is similar to that which is explained above in the first example of the vacuum cleaner 100, repetitious explanation thereof is omitted.

Referring to the example shown in FIG. 6A, an air stream, cleaned by the pre-motor filter 225, is discharged downward to move into a motor suction path 206*a*, passed through the suction motor 260, and discharged into a motor discharge path 206*b* via a motor discharge hole 261.

Referring to the example in FIG. 6B, an air stream in the motor discharge path 206*a* may be introduced into the filter receiving opening 231*a* through the first communicating port 235 of the discharge filter body 231 formed on the rear surface 201*a* of the cleaner body 201. Referring to the example in FIG. 6C, the air stream may be moved toward the discharge filter cover 233 during which impurities, such as carbon powder discharged from the suction motor 260, may be filtered by the filter member 234. After that, a part of the filtered air stream filtered by the filter member 234 may be discharged through the discharging port 233*a* of discharge filter cover 233, and the remaining air stream may be introduced into the cord reel assembly 250 through a duct formed by the extended portion 238 and the second communication port 253 to cool the power cord reel (not illustrated) housed in the cord reel assembly 250. Referring to the example in FIG. 6D, the air stream may be discharged out of the cord reel assembly 250 through the discharge grill 255 formed on a front portion of the cord reel assembly 250.

Meanwhile, if it is necessary to clean or replace the filter member 234 with a new one, the user may pivot the discharge filter cover 233 to open the discharge filter body 231, and take out the filter member 234 from the filter receiving opening 231*a*.

As explained above, it is possible to clean or replace the filter member 234 by pivoting the discharge filter cover 233 and removing the filter member 234 from the vacuum cleaner 200.

Furthermore, the discharge filter unit 230 may not only remove impurities from the air stream from the suction motor 260, but also shift the flow of a part of the impurity-cleaned air stream.

Furthermore, since the extended portion 238 may be integrally formed on the discharge filter cover 233, the discharge filter cover 233 may serve as not only a cover to close the filter member 234, but also a duct through which an air stream from the discharge filter unit 230 is moved to the cord reel assembly 250.

Furthermore, since the discharge filter unit 230 and the cord reel assembly 250 may be perpendicularly arranged and fluidly connected to each other in an adjoining manner, a part of an air stream from the discharge filter unit 230 may change a direction to pass through the interior of the cord reel assembly 250, before the air stream is discharged out of the vacuum cleaner 200.

Because it is possible to separate the filter member from the vacuum cleaner for cleaning by pivoting the discharge filter cover to open the discharge filter body, cleaning the discharge filter may become relatively convenient compared to the conventional vacuum cleaners.

Furthermore, since the extended portion may be integrated with the discharge filter, the discharge filter may serve as not only a cover to close the filter member, but also a duct through which an air stream from the discharge filter unit changes its direction to move to the cord reel assembly. Accordingly, since it is unnecessary to form a separate passage, a number of parts used may be reduced.

A number of examples have been described above. Nevertheless, it will be understood that various modifications may be made. For example, suitable results may be achieved if the described techniques are performed in a different order and/or if components in a described system, architecture, device, apparatus, or circuit are combined in a different manner and/or replaced or supplemented by other components or their equivalents. Accordingly, other implementations are within the scope of the following claims.

What is claimed is:

1. An upright-type vacuum cleaner, comprising:

a cleaner body comprising a motor chamber in which a suction motor is mounted;

a brush assembly connected to the cleaner body;

a discharge filter unit mounted on a first surface of the cleaner body, the discharge filter unit configured to filter out impurities from an air stream discharged from the suction motor; and a cord reel assembly mounted on a second surface of the cleaner body, the cord reel assembly comprising a power cord, wherein the discharge filter unit comprises a filter member mountable and demountable to and from the cleaner body outside the vacuum cleaner, and wherein at least a part of the filtered air stream shifts a direction to pass through the cord reel assembly.

2. The upright-type vacuum cleaner of claim 1, wherein:

the discharge filter unit is mounted on a side surface of the cleaner body; and the cord reel assembly is mounted on a rear surface of the cleaner body adjoined and fluidly connected to the discharge filter unit.

3. The upright-type vacuum cleaner of claim 1, wherein:

the discharge filter unit is mounted on a rear surface of the cleaner body, and the cord reel assembly is mounted on a side surface of the cleaner body adjoined and fluidly connected to the discharge filter unit.

4. The upright-type vacuum cleaner of claim 2, wherein the discharge filter unit further comprises:

a discharge filter body formed on the cleaner body, the discharge filter body to which the filter member may be removably mounted; and a discharge filter cover configured to selectively open the discharge filter body, wherein the discharge filter cover comprises:

a hinge portion formed on a first side to be pivotably connected to the discharge filter body, and a pair of locking portions formed on a second side at a predetermined distance from each other to be selectively locked with the discharge filter body.

5. The upright-type vacuum cleaner of claim 4, wherein the discharge filter cover comprises an extended portion between the pair of locking portions, to form a duct passage through which, in a state that the discharge filter cover closes the discharge filter body, an air stream, from which impurities are filtered as the air stream is passed through the filter member, changes a flow direction perpendicularly to thus move into the cord reel assembly.

6. The upright-type vacuum cleaner of claim 5, wherein the discharge filter body comprises a first communicating port formed on a lower portion and fluidly connected to the motor chamber, and a second communicating port formed on a location of a side surface corresponding to the extended portion and fluidly connected to an interior of the cord reel assembly.

7. The upright-type vacuum cleaner of claim 5, wherein the discharge filter body comprises a first communicating port formed on a lower portion and fluidly connected to the motor chamber, and the cord reel assembly comprises a second communicating port formed on a location of a rear surface corresponding to the extended portion and fluidly connected to an interior of the cord reel assembly.

8. The upright-type vacuum cleaner of claim 1, wherein the discharge filter unit shifts a flow of the filtered air stream.

9. The upright-type vacuum cleaner of claim 1, wherein the discharge filter unit and the cord reel assembly extend from the cleaner body.

10. A vacuum cleaner, comprising:

a cleaner body;

a brush portion;

a suction motor;

a cyclone unit;

a pre-motor filter unit;

a discharge filter mounted on the cleaner body; and a cord reel assembly mounted on the cleaner body on a different plane than the discharge filter, wherein:

an air stream is drawn into the cyclone unit where dust is separated from the air stream, the air stream is discharged to the pre-motor filter unit where residual dust is removed, the air stream flows through the suction motor to the discharge filter where the airstream is filtered, and at the discharge filter:

a portion of the filtered air stream is discharged through a discharging portion, and another portion of the filtered air stream is shifted in direction by an extended portion to pass through the cord reel assembly.

11. The upright-type vacuum cleaner of claim 1, wherein the discharge filter unit and the cord reel assembly are mounted on the exterior surface of the cleaner body.

* * * * *